US011864644B2

(12) United States Patent
Tai et al.

(10) Patent No.: US 11,864,644 B2
(45) Date of Patent: Jan. 9, 2024

(54) HEAT DISSIPATING BACKPACK

(71) Applicant: Gizmospring.com Dongguan Limited, Dongguan (CN)

(72) Inventors: Kenny Chih-Yao Tai, Dongguan (CN); Yueh-Ting Lee, Dongguan (CN); Jin Biao Zhang, Dongguan (CN); Hung Yang, Dongguan (CN); Gustavo Ricarte Teixeira, Dongguan (CN)

(73) Assignee: Gizmospring.com Dongguan Limited, Dongguan (CN)

( * ) Notice: Subject to any disclaimer, the term of this patent is extended or adjusted under 35 U.S.C. 154(b) by 0 days.

(21) Appl. No.: 17/583,906

(22) Filed: Jan. 25, 2022

(65) Prior Publication Data

US 2023/0232966 A1 Jul. 27, 2023

(51) Int. Cl.

| | |
|---|---|
| ***A45F 3/04*** | (2006.01) |
| *A45F 3/00* | (2006.01) |
| *A45F 3/12* | (2006.01) |

(52) U.S. Cl.

CPC ..... *A45F 3/04* (2013.01); *A45F 2003/003* (2013.01); *A45F 2003/122* (2013.01); *A45F 2003/125* (2013.01)

(58) Field of Classification Search

CPC ..... A45F 2003/122; A45F 2003/125

See application file for complete search history.

(56) References Cited

U.S. PATENT DOCUMENTS

| | | | | | |
|---|---|---|---|---|---|
| 3,353,191 | A * | 11/1967 | Dahly | ..... | A42C 5/04 62/235.1 |
| 5,577,611 | A * | 11/1996 | Greenall | ..... | A45F 3/44 190/18 R |
| 5,762,243 | A * | 6/1998 | McMaster | ..... | A45F 3/08 224/262 |
| 5,823,414 | A | 10/1998 | Gal et al. | | |
| 5,836,671 | A | 11/1998 | Chien | | |
| 7,249,464 | B1 | 7/2007 | Watson | | |
| 7,272,946 | B2 | 9/2007 | Ichigaya | | |

(Continued)

FOREIGN PATENT DOCUMENTS

| | | | | | |
|---|---|---|---|---|---|
| CN | 101396200 | A * | 4/2009 | ..... | A45F 5/00 |
| CN | 201468227 | | 5/2010 | | |

(Continued)

OTHER PUBLICATIONS

Amazon.co.jp (publication date unknown), retrieved on Jul. 3, 2019 (Year: 2019).*

(Continued)

*Primary Examiner* — Scott T McNurlen

(74) *Attorney, Agent, or Firm* — Davis Wright Tremaine LLP; Heather M. Colburn

(57) ABSTRACT

A panel attachable to a backpack body. The panel having at least one through-hole formed therein to allow air to flow into a gap defined between the panel and the backpack body. An air-moving device is mountable to the panel, with an outer portion of the air-moving device extending forwardly from the panel and an inner portion of the air-moving device positioned in the gap. The air-moving device causes air to flow into the gap through the at least one through-hole and into one or more inlets of the inner portion. The air-moving device causes air to flow out one or more outlets of the outer portion.

41 Claims, 8 Drawing Sheets

(56) References Cited

U.S. PATENT DOCUMENTS

| | | | | |
|---|---|---|---|---|
| 7,900,757 | B2 | 3/2011 | Sisitsky | |
| 9,204,674 | B2 | 12/2015 | Bujold | |
| 10,555,594 | B2 | 2/2020 | Tai et al. | |
| 11,452,360 | B1 * | 9/2022 | Cedeno, Sr. | G06F 1/189 |
| 2010/0116861 | A1 | 5/2010 | Burrowes | |
| 2015/0075185 | A1 | 3/2015 | Sims | |
| 2017/0023267 | A1 | 1/2017 | Strauss | |
| 2017/0181529 | A1 | 6/2017 | Tatsumi | |
| 2019/0075912 | A1 * | 3/2019 | Squires | A45F 3/04 |
| 2019/0093929 | A1 | 3/2019 | Ye | |
| 2020/0196738 | A1 | 6/2020 | Valvano et al. | |

FOREIGN PATENT DOCUMENTS

| | | | |
|---|---|---|---|
| CN | 203424539 | | 2/2014 |
| CN | 204734057 | | 11/2015 |
| CN | 105342103 | | 2/2016 |
| CN | 205040889 | | 2/2016 |
| CN | 206119553 | | 4/2017 |
| CN | 107752328 | | 3/2018 |
| CN | 107853857 | A * | 3/2018 |
| CN | 109106048 | | 1/2019 |
| CN | 109757852 | | 5/2019 |
| DE | 202013011211 | | 5/2014 |
| DE | 102018128614 | | 5/2020 |
| DE | 102020125927 | A1 * | 4/2022 |
| JP | 2004147871 | | 5/2004 |
| JP | 6327778 | | 4/2018 |
| KR | 20100008156 | A * | 1/2010 |
| WO | 2006068072 | | 6/2006 |

OTHER PUBLICATIONS

Amazon.co.jp/ZenCT (publication date unknown), retrieved on Jul. 3, 2019 (Year: 2019).*

International Search Report and Written Opinion, dated May 14, 2023, received in International Application No. PCT/CN2023/073468.

Tec Snake Ltd., "ACOOL Bag: The World's Best Cooling Backpack," 2019, [Retrieved on Jul. 3, 2019] Retrieved from the Internet: https://www.indiegogo.com/projects/acool-bag-the world-s-best-cooling-backpack#/.

International Search Report and Written Opinion, dated Oct. 10, 2018, received in Interanational Application No. PCT/US2018/042544.

* cited by examiner

HEAT DISSIPATING BACKPACK

BACKGROUND

Technical Field

The present invention is directed generally to backpacks, and more particularly to backpacks designed to dissipate heat.

Description of the Related Art

A backpack has one or more forward facing surfaces that is/are positioned adjacent to the back of the human wearer of the backpack and may press against the back of the wearer, and cause trap heat along the wearer's back. This heat may cause the wearer to perspire, which may wet and soil the forward-facing surface(s) of the backpack. The heat may also cause discomfort to the wearer.

BRIEF DESCRIPTION OF THE SEVERAL VIEWS OF THE DRAWING(S)

Various embodiments in accordance with the present disclosure will be described with reference to the following drawings.

Like reference numerals have been used in the figures to identify like components.

DETAILED DESCRIPTION

Figure 1:
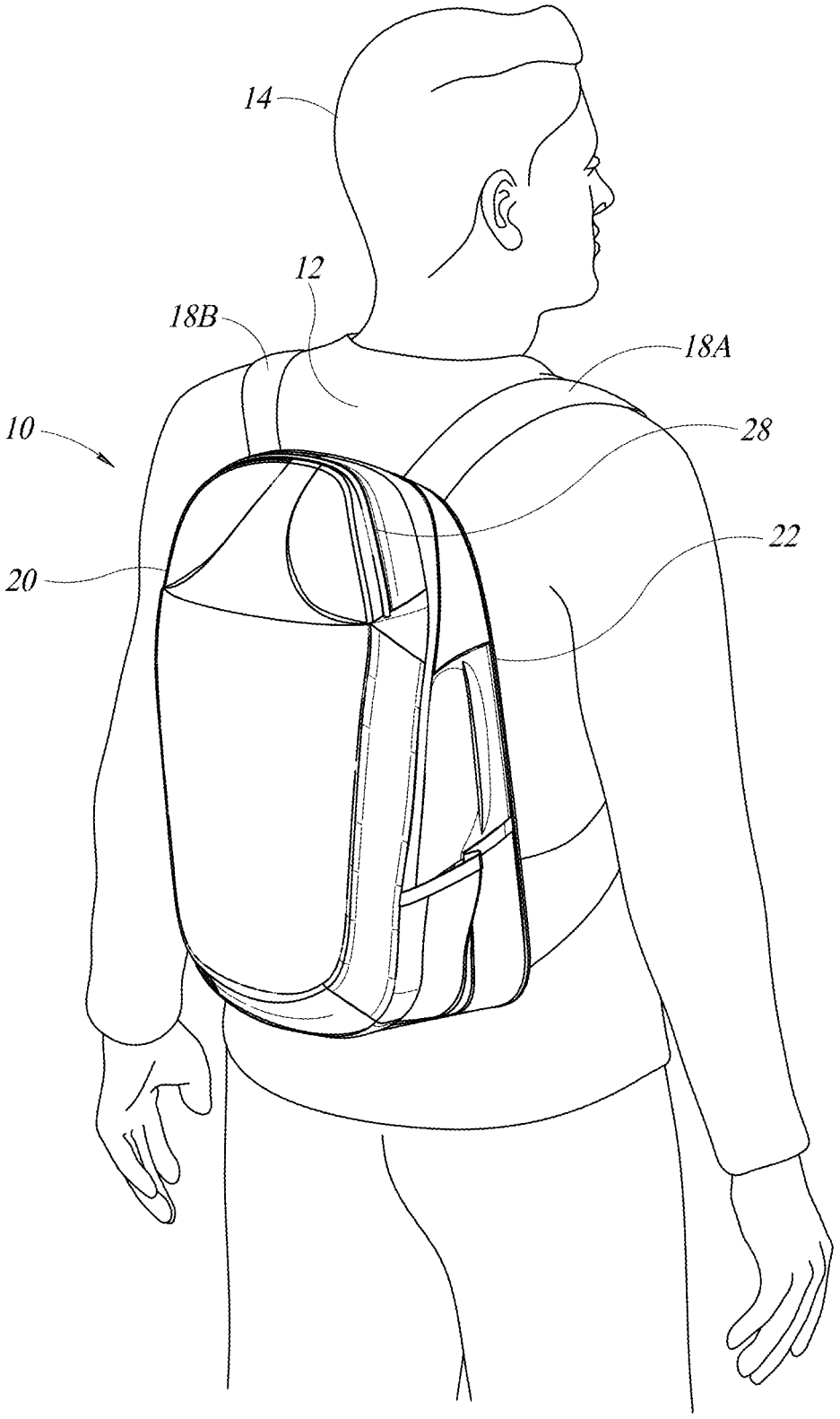
FIG. 1 is a perspective view of a backpack illustrated being worn on a wearer's back.

FIG. 1 illustrates a backpack 10 configured to be worn on a back 12 of a human user or wearer 14 and, when worn, to help dissipate heat along the wearer's back 12. The backpack 10 includes shoulder straps 18A and 18B, a backpack body 20, a forward-facing panel 22, one or more air-moving devices 24 (see FIGS. 2 and 4-7), and electrical components 26 (see FIGS. 6 and 7). When the wearer 14 is wearing the backpack 10, the forward-facing panel 22 (e.g., a backing pad) is positioned adjacent to the back 12 of the wearer 14. At least a portion of the forward-facing panel 22 may contact the back 12 of the wearer 14. The backpack body 20 may have a bag like shape with an internal compartment (not shown) for storing items and at least one closure 28 (e.g., a zipper) that provides access to and closes the internal compartment (not shown).

Figure 2:
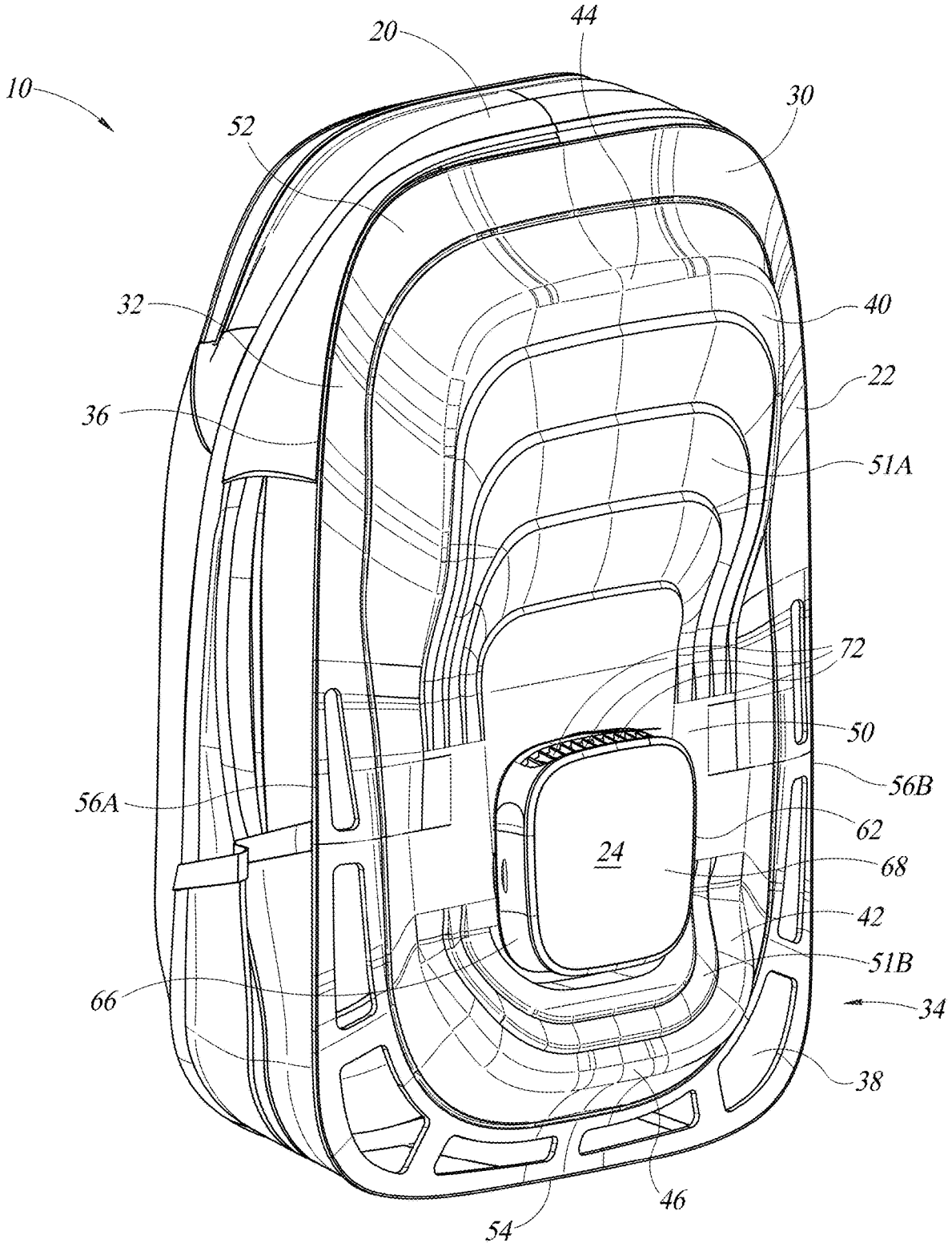
FIG. 2 is a perspective view of a forward-facing panel of the backpack of FIG. 1 omitting its shoulder straps.

Referring to FIG. 2, the forward-facing panel 22 has a forward-facing contoured surface 30 including a peripheral portion 32. At least a portion of the peripheral portion 32 is attached to the backpack body 20. One or more through-holes 34 are formed in the peripheral portion 32. In the embodiment illustrated in FIG. 3, the through-hole(s) 34 include through-holes 34A-34H. Referring to FIG. 2, the through-hole(s) 34 may extend alongside an outer periphery 36 of the forward-facing panel 22 and may at least partially surround the air-moving device(s) 24. In the embodiment illustrated, both the through-hole(s) 34 and the air-moving device(s) 24 are positioned in a lower half of the forward-facing panel 22. The through-hole(s) 34 allow air to flow into an air gap 38 defined between the forward-facing panel 22 and the backpack body 20.

The contoured surface 30 has a first tapered portion 40 positioned at least partially above the air-moving device(s) 24 and a second tapered portion 42 positioned at least partially below the air-moving device(s) 24. The first tapered portion 40 includes an upper ridge 44 that may have an outer uppermost shape that follows or corresponds to an upper portion of the outer periphery 36. The second tapered portion 42 includes a lower ridge 46 that may have a shape that follows or corresponds to a lower portion of the outer periphery 36. A recessed portion 50 is defined between the first and second tapered portions 40 and 42. The first tapered portion 40 includes a stepped portion 51A that extends from the recessed portion 50 to the upper ridge 44. Similarly, the second tapered portion 42 includes a stepped portion 51B that extends from the recessed portion 50 to the lower ridge 46. In the embodiment illustrated, the stepped portion 51A includes four steps and the stepped portion 51B includes two steps. However, the upper ridge 44 may be characterized as being a fifth step of the stepped portion 51A and the lower ridge 46 may be characterized as being a third step of the stepped portion 51B.

The recessed portion 50 is positioned between the first and second tapered portions 40 and 42 and is rearwardly with respect to the upper and lower ridges 44 and 46. The upper and lower ridges 44 and 46 may contact the wearer's back 12 (see FIG. 1) when the backpack 10 is worn by the wearer 14 (see FIG. 1) and space the recessed portion 50 of the contoured surface 30 away from the wearer's back 12. Further, at least portions of the stepped portions 51A and 51B near the recessed portion 50 may also be spaced away from the wearer's back 12 to help provide airflow thereto. The upper and lower ridges 44 and 46 may help at least partially trap flowing air within the recessed portion 50. This trapped air may escape the recessed portion 50 by traveling between the first and second tapered portions 40 and 42 toward the sides 56A and 56B of the outer periphery 36.

In the embodiment illustrated, the upper ridge 44 has a generally C-shaped outer shape that is downward opening and the lower ridge 46 has a generally C-shaped outer shape that is upward opening. The downward opening in the outer shape of the upper ridge 44 is juxtaposed with the upward opening in the outer shape of the lower ridge 46. The upper ridge 44 tapers forwardly away from the backpack body 20 as the upper ridge 44 extends upwardly away from the downward opening in its outer shape. Similarly, the lower ridge 46 tapers forwardly away from the backpack body 20 as the lower ridge 46 extends downwardly away from the downward opening in its outer shape. Thus, a rearward most portion of the forward-facing panel 22 may be positioned in the recessed portion 50.

The upper and lower ridges 44 and 46 are spaced apart from one another with the air-moving device(s) 24 positioned therebetween. In the embodiment illustrated, the air-moving device(s) 24 is/are at least partially nested inside the upward opening outer C-shape of the lower ridge 46. Alternatively or additionally, the air-moving device(s) 24 may be at least partially nested inside the downward opening outer C-shape of the upper ridge 44. By way of another non-limiting example, the air-moving device(s) 24 may be spaced apart from or positioned outside one or both of the outer C-shapes defined by the upper and lower ridges 44 and 46, respectively.

The peripheral portion 32 extends along the outer periphery 36 and around both the first and second tapered portions 40 and 42. The peripheral portion 32 has an outer surface 52 that may be contoured and may slope rearwardly toward the outer periphery 36. In the embodiment illustrated, the through-hole(s) 34 are formed in the peripheral portion 32 and are arranged to define a generally C-shaped shape. The through-hole(s) 34 may extend from a location alongside a bottom portion 54 of the outer periphery 36 upwardly along both sides 56A and 56B of the outer periphery 36. In the embodiment illustrated, the through-hole(s) 34 may extend upwardly along both the sides 56A and 56B to positions above the air-moving device(s) 24. Thus, the air-moving device(s) 24 may be at least partially nested inside the general C-shape defined by the through-hole(s) 34. The through-hole(s) 34 may have different sizes (e.g., different surface areas).

Figure 3:
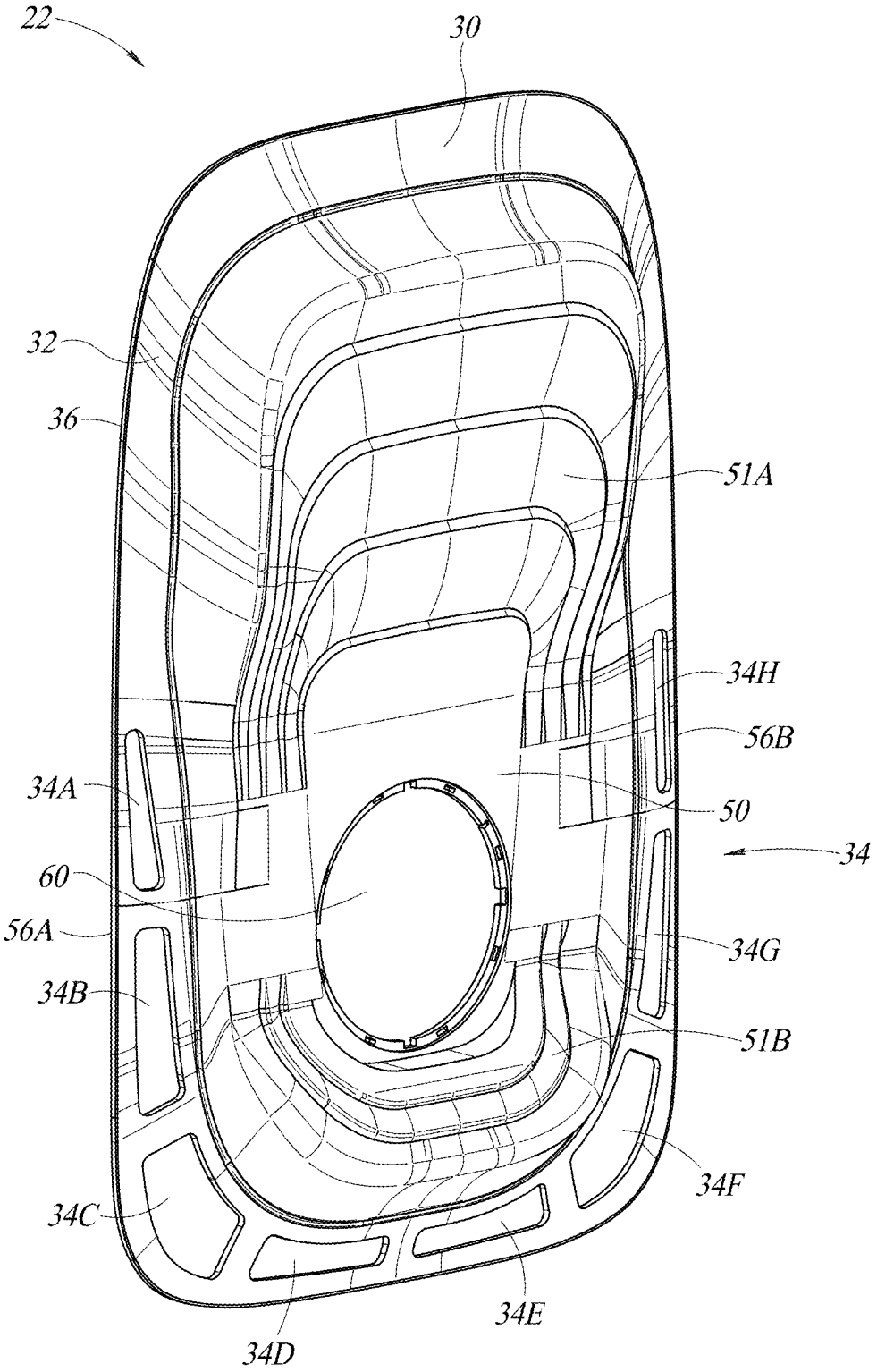
FIG. 3 is a perspective view of a forward-facing contoured surface of the forward-facing panel of FIG. 2.

As mentioned above, in the embodiment illustrated, the recessed portion 50 extends outwardly between the first and second tapered portions 40 and 42 toward the sides 56A and 56B of the outer periphery 36. Referring to FIG. 3, at least one through-hole 60 may be formed in the recessed portion 50 of the forward-facing panel 22 at a position spaced inwardly from the sides 56A and 56B of the outer periphery 36. Referring to FIG. 2, the air-moving device(s) 24 may be mounted inside the through-hole(s) 60 (see FIG. 3) with an external or outlet portion 62 of each of the air-moving device(s) 24 extending outwardly from the through-hole(s) 60 toward the wearer's back 12 (see FIG. 1) and an internal or inlet portion 64 (see FIG. 4) of each of the air-moving device(s) 24 extending inwardly from the through-hole(s) 60 into the gap 38 (see FIG. 2) defined between the forward-facing panel 22 and the backpack body 20 (see FIGS. 1 and 2).

The air-moving device(s) 24 may each include an outer housing 66 that is mounted in the through-hole(s) 60 (see FIG. 3). The outlet portion 62 of the outer housing 66 of each of the air-moving device(s) 24 may have a flat surface 68. The flat surface 68 may be positioned rearwardly with respect a forwardmost point of the upper and lower ridges 44 and 46. Alternatively, the flat surface 68 may be positioned to contact the back 12 (see FIG. 1) of the wearer 14 (see FIG. 1). For example, the flat surface 68 may be flush with the upper ridge 44 and/or lower ridge 46.

Figure 4:
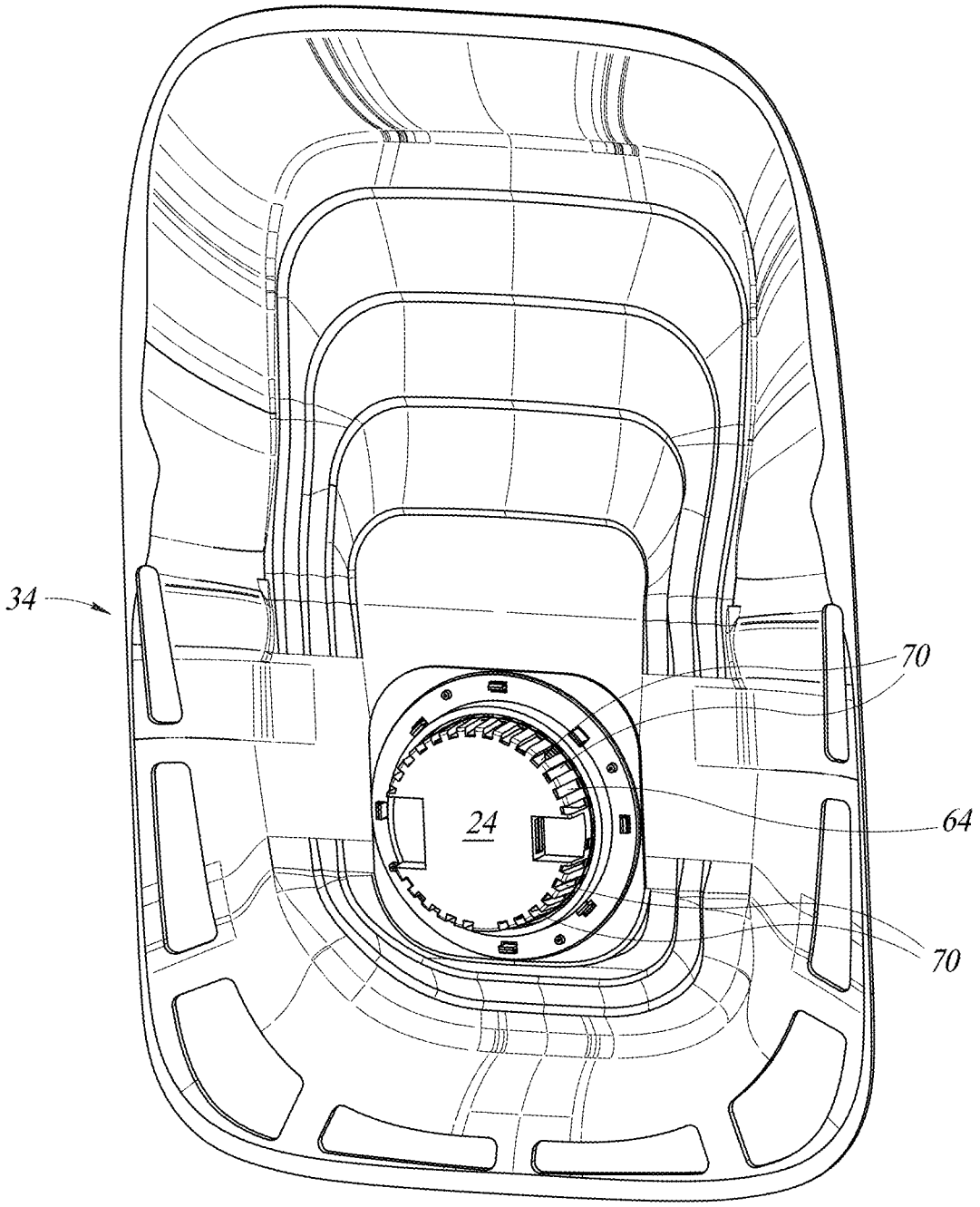
FIG. 4 is a perspective view of a backward-facing surface of the forward-facing panel of FIG. 2 illustrated with an air-moving device mounted therein.

Referring to FIG. 4, the air-moving device(s) 24 may be implemented as one or more fans. Each of the air-moving device(s) 24 has one or more air inlets 70 formed in the inlet portion 64 that draw(s) air into the air-moving device(s) 24 from the gap 38 (see FIGS. 2 and 5). Air may flow through the through-hole(s) 34, into the gap 38, and enter an interior of the air-moving device(s) 24 through the air inlet(s) 70. Referring to FIG. 2, the air-moving device(s) 24 has one or more air outlets 72 formed in the outlet portion 62 that move (e.g., blow) air from the interior of the air-moving device(s) 24 upwardly or vertically along the contoured surface 30. In the embodiment illustrated, the air outlet(s) 72 are positioned along the top of the air-moving device(s) 24.

In the embodiment illustrated, the air-moving device(s) 24 and the electrical components 26 (see FIGS. 6 and 7) form a subassembly housed inside the housing 66. The housing 66, including the air-moving device(s) 24 and the electrical components 26, may be removable and separable from the through-hole(s) 60 (see FIG. 3). In other words, the air-moving device(s) 24 and the electrical components 26 may be removed from a remainder of the backpack 10 (e.g., the backpack body 20 and the forward-facing panel 22) as a unit. Referring to FIG. 8, after the housing 66 (see FIG. 2) is removed from the through-hole(s) 60, a cover 74 may be inserted into the through-hole(s) 60. In the embodiment illustrated, the through-hole(s) 60 is defined by an interior peripheral edge 76. Notches 78A-78D are formed in the peripheral edge 76.

Figure 8:
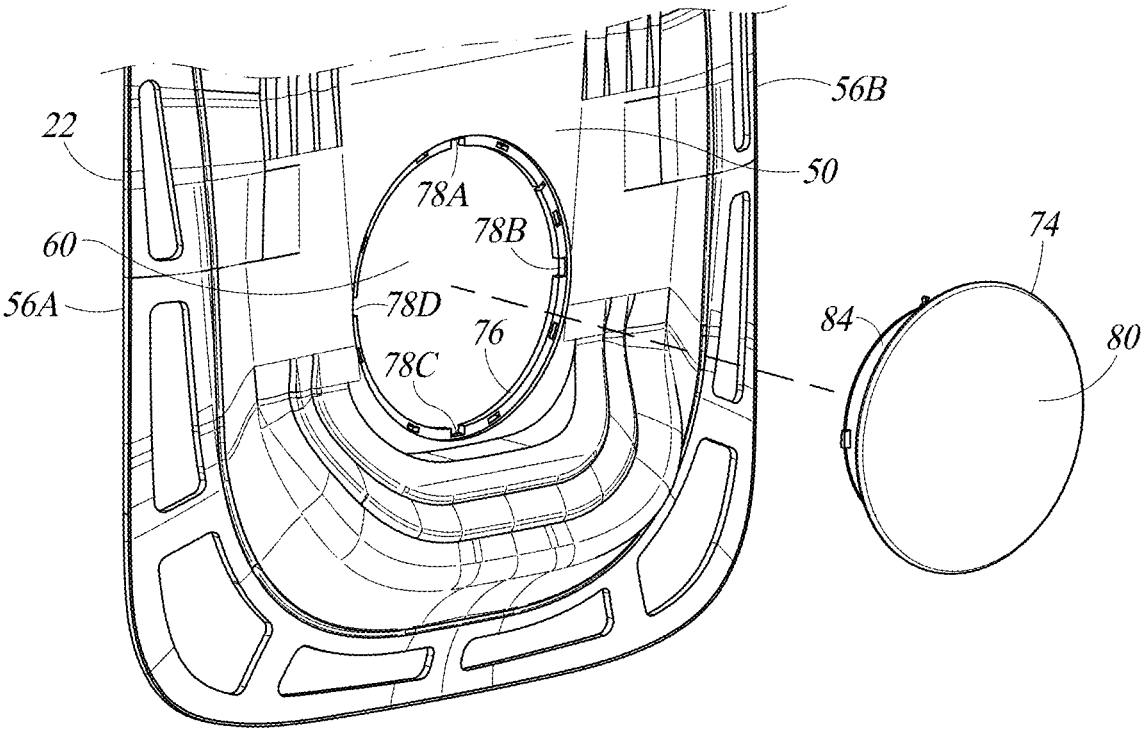
FIG. 8 is a perspective exploded view of the forward-facing contoured surface of the forward-facing panel of FIG. 2 and an optional cover.
Figure 9:
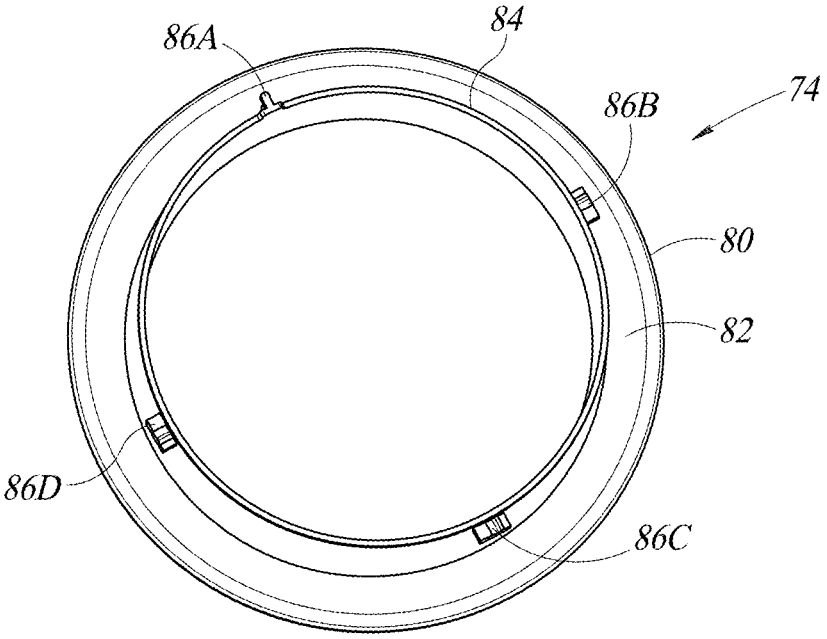
FIG. 9 is a perspective view of a backward-facing side of the optional cover.

In the embodiment illustrated in FIG. 8, the cover 74 includes a cover portion 80 that is larger than the through-hole(s) 60 and will not pass therethrough. The cover portion 80 has a backward-facing surface 82 (see FIG. 9) that is positionable adjacent to a portion of the recessed portion 50 surrounding the through-hole(s) 60. For example, the backward-facing surface 82 may rest against the recessed portion 50. An attachment portion 84 extends away from the cover portion 80 and is configured to be received inside the through-hole(s) 60. In the embodiment illustrated, the attachment portion 84 has a generally cylindrical outer-shape sized to be received inside a generally circular through-hole. The attachment portion 84 includes outwardly extending tabs 86A-86D positioned to be received inside the notches 78A-78D, respectively, and to pass therethrough. Then, the cover 74 may be rotated to position the tabs 86A-86D so that they are no longer aligned with the notches 78A-78D, respectively, and cannot travel outwardly therethrough. In other words, the tabs 86A-86D may form a bayonet style mount between the cover 75 and the forward-facing panel 22. The cover 74 may be removed from the through-hole(s) 60 by rotating the cover 74 to align the tabs 86A-86D with the notches 78A-78D, respectively, and pulling the attachment portion 84 of the cover 74 out through the through-hole(s) 60 until the cover 74 is free of the forward-facing panel 22. The housing 66 may be installed inside the through-hole(s) 60 after the cover 74 is removed from the through-hole(s) 60.

Figure 5:
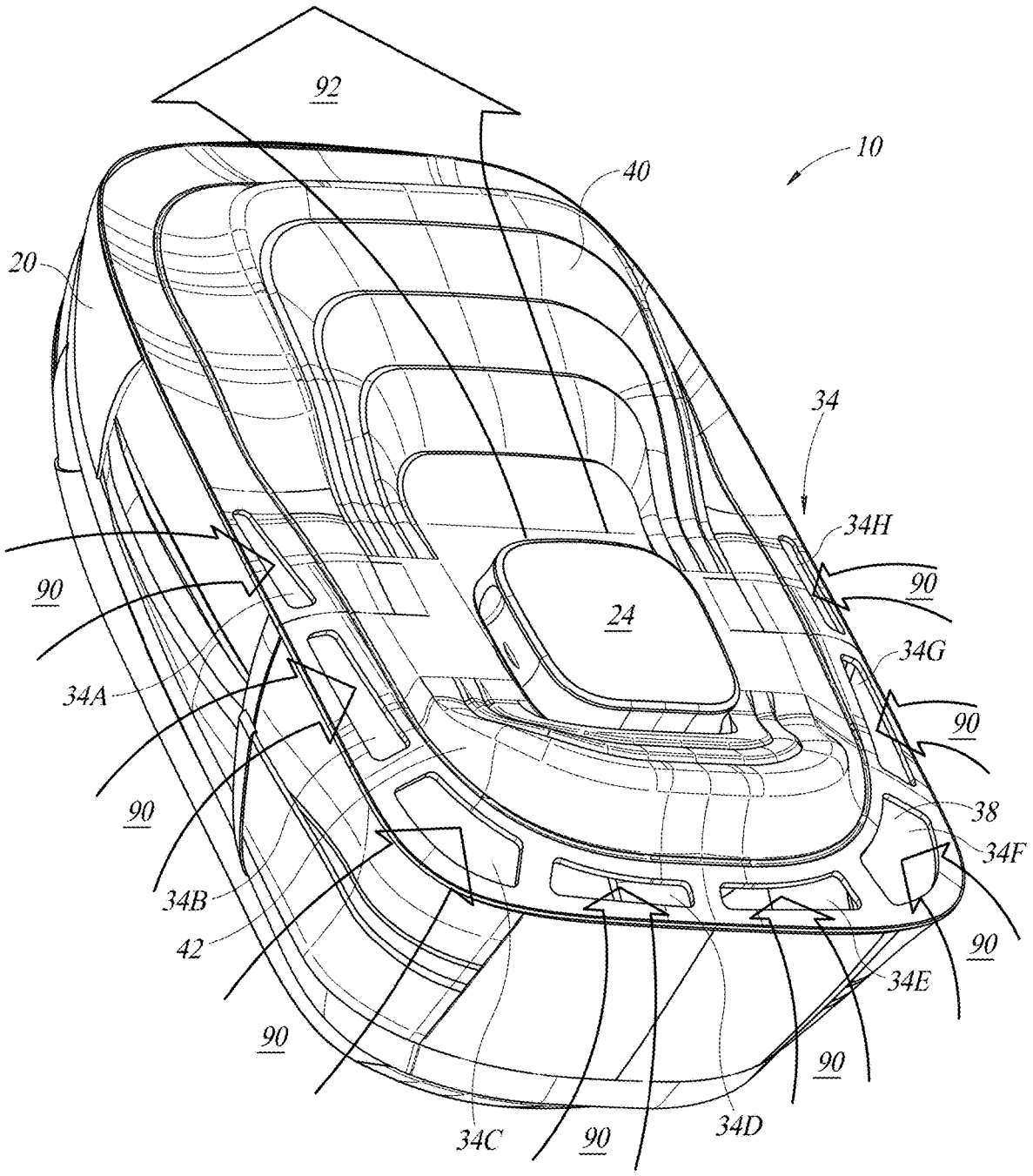
FIG. 5 is a perspective view of the backpack of FIG. 1 omitting its shoulder straps and illustrated with arrows depicting airflow generated by the air-moving device.

In the embodiment illustrated in FIG. 5, the air-moving device(s) 24 (e.g., a fan) is positioned in the lower portion of the forward-facing panel 22, draws one or more input airflows 90 into the gap 38 through the through-hole(s) 34, and directs one or more output airflows 92 outwardly in an upward direction. The output airflow(s) 92 travel forwardly along the first tapered portion 40 toward the upper ridge 44. In the embodiment illustrated, the output airflow(s) 92 may traverse the stepped portion 51 as the output airflow(s) 92 travel toward the upper ridge 44. At least a first portion of the output airflow(s) 92 may flow outwardly between the upper ridge 44 and the wearer's back 12 (see FIG. 1). At least a second portion of the output airflow(s) 92 may be directed downwardly toward the lower ridge 46 by the first tapered portion 40, the stepped portion 51, and/or the upper ridge 44. The second portion of the output airflow(s) 92 may flow within the recessed portion 50 and exit therefrom between the first and second tapered portion 40 and 42.

As mentioned above referring to FIG. 2, the upper and lower ridges 44 and 46 may contact the back 12 (see FIG. 1) of the wearer 14 (see FIG. 1) and space the recessed portion 50 of the contoured surface 30 away from the wearer's back 12. Thus, the upper and lower ridges 44 and 46 reduce an amount of surface area in contact with the wearer's back 12, which may help reduce an amount of heat trapped between the forward-facing panel 22 and the wearer's back 12. Further, the air-moving device(s) 24 is positioned within the recessed portion 50 to help dissipate heat trapped between the forward-facing panel 22 and the wearer's back 12. Thus, the backpack 10 helps dissipate heat.

The forward-facing panel 22 may be molded as or from a single sheet of material. For example, the forward-facing panel 22 may be formed by vacuum molding, injection molding, and the like.

Figure 6:
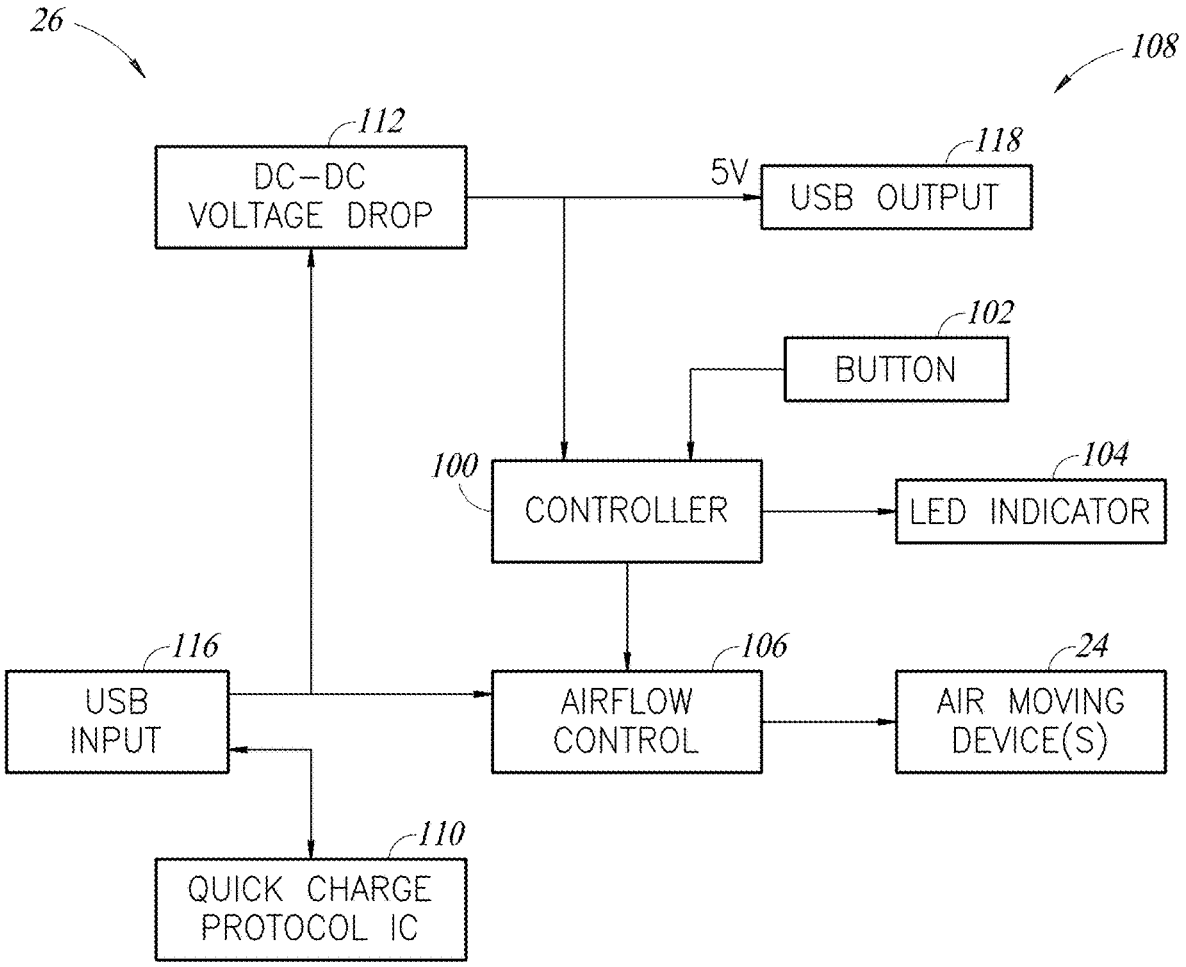
FIG. 6 is a block diagram illustrating electrical components of the backpack of FIG. 1.
Figure 7:
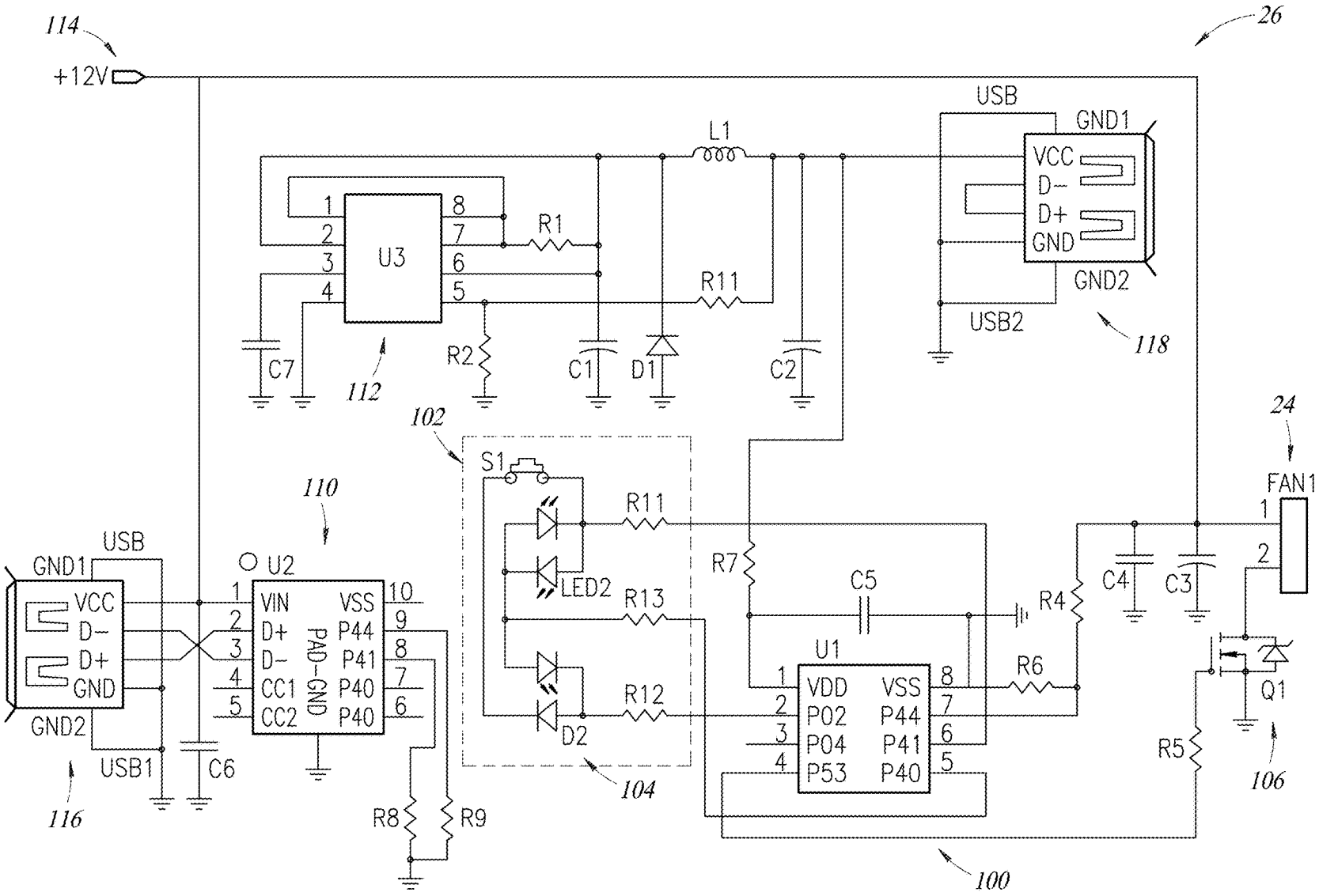
FIG. 7 is a circuit diagram illustrating an example implementation of the electrical components of the backpack of FIG. 1.

Referring to FIGS. 6 and 7, the electrical components 26 of the backpack 10 (see FIGS. 1, 2, and 5) include the air-moving device(s) 24, a controller 100 (e.g., a microcontroller), one or more switches or buttons 102, one or more indicators 104, an airflow control 106, one or more Universal Serial Bus ("USB") ports 108, a quick charge protocol integrated circuit ("IC") 110, direct current to direct current ("DC-DC") voltage drop circuitry 112, and a power source 114 (see FIG. 7). In FIGS. 6 and 7, the USB port(s) 108 (see FIG. 6) include(s) an input USB port 116 and an output USB port 118. However, in some embodiments, the input and output USB ports 116 and 118 may be implemented as the same port. The controller 100 may be implemented as a microcontroller (e.g., a model S3C7031 microcontroller), microprocessor, and the like. The indicator(s) 104 may be implemented as one or more light emitting diodes ("LEDs"). The airflow control 106 may be implemented as a metal-oxide-semiconductor field-effect transistor ("MOSFET"), such as a type 3400 MOSFET. By way of a non-limiting example, the IC 110 may be implemented as a USB Power Delivery controller (e.g., a model HUSB238 with ten pins). The circuitry 112 may be implemented as a switching regulator (e.g., a model MC34063). Referring to FIG. 7, the power source 114 may be implemented as one or more batteries.

Referring to FIG. 7, the electrical components 26 may include a multi-level speed-regulating module that is connected to the air-moving device(s) 24. The multi-level speed-regulating module may include a speed control circuit that includes the controller 100, an output interface that includes the airflow control 106, and a switching circuit that includes the button(s) 102. In the embodiment illustrated, the button(s) 102 include a single button S1 and the air-moving device(s) 24 include one or more fans (e.g., a fan FAN1). The controller 100 is operable to use the airflow control 106 to change the rate of airflow generated by the fan(s) (e.g., by changing the speed of the fan(s)) each time the single button S1 is pressed. For example, the controller 100 may increase the rate of airflow each time the single button S1 is pressed until a maximum flow rate is achieved. Then, the next time the single button S1 is pressed, the rate of airflow may be set to a minimum flow rate. In other words, the controller 100 may cycle through a set of predetermined airflow rates.

At least one embodiment of the disclosure can be described in view of the following clauses.

1. A backpack comprising: a backpack body; a forward-facing panel; and an air-moving device, the forward-facing panel being attached to the backpack body, the forward-facing panel having at least one through-hole formed therein to allow air to flow into a gap defined between the forward-facing panel and the backpack body, the forward-facing panel having a forward-facing contoured surface that comprises at least one forwardly extending ridge that rests on a back of a wearer when the backpack is worn by the wearer to space a recessed portion of the forward-facing panel away from the back of the wearer, the air-moving device being mountable in the recessed portion of the forward-facing panel, an outer portion of the air-moving device extending forwardly from the forward-facing panel when the air-moving device is mounted in the recessed portion, an inner portion of the air-moving device being positioned in the gap when the air-moving device is mounted in the recessed portion, the inner portion comprising one or more inlets positioned inside the gap when the air-moving device is mounted in the recessed portion, the outer portion comprising one or more outlets positioned inside the recessed portion when the air-moving device is mounted in the recessed portion, the air-moving device causing air to flow into the gap through the at least one through-hole and into the one or more inlets when the air-moving device is operating and is mounted in the recessed portion, the air-moving device causing air to flow out the one or more outlets when the air-moving device is operating and is mounted in the recessed portion.

2. The backpack of clause 1, wherein the at least one forwardly extending ridge comprises an upper ridge and a lower ridge, at least a portion of the recessed portion being between the upper ridge and the lower ridge.

3. The backpack of clause 2, wherein the forward-facing contoured surface comprises a stepped portion that extends from the recessed portion to the upper ridge.

4. The backpack of any one of the clauses 1-3, wherein the at least one through-hole comprises a plurality of through-holes arranged along a portion of a periphery of the forward-facing panel.

5. The backpack of clause 4, wherein the plurality of through-holes extends along a lower portion of the periphery and up first and second sides of the periphery, at least a first one of the plurality of through-holes is positioned along the first side at a location that is above the air-moving device when the air-moving device is mounted in the recessed portion, and at least a second one of the plurality of through-holes is positioned along the second side at a location that is above the air-moving device when the air-moving device is mounted in the recessed portion.

6. The backpack of any one of the clauses 1-5, wherein the air-moving device comprises an outer housing, and the forward-facing panel comprises an opening into which the outer housing is mountable.

7. The backpack of clause 6, wherein the outer housing has a flat surface positioned in the outer portion, and the flat surface is positioned rearwardly with respect a forwardmost point of the at least one forwardly extending ridge when the air-moving device is mounted in the recessed portion.

8. The backpack of clause 6 or clause 7, wherein the outer housing is removable from the opening, and the backpack further comprises: a cover to be positioned inside the opening after the outer housing is removed from the opening.

9. The backpack of any one of the clauses 1-8, wherein the at least one forwardly extending ridge helps at least partially trap flowing air within the recessed portion.

10. The backpack of clause 9, wherein the at least one forwardly extending ridge comprises an upper ridge and a lower ridge, each of the upper and lower ridges has C-shaped outer shape with an opening, the opening of the upper ridge is juxtaposed with the opening of the lower ridge, a portion of the air-moving device is positioned within the opening of the lower ridge when the air-moving device is mounted in the recessed portion, and at least a portion of the recessed portion is positioned within the opening of the upper ridge and the opening of the lower ridge.

11. The backpack of clause 10, wherein the C-shaped outer shape of the upper ridge tapers from the opening of the upper ridge to an uppermost point of the upper ridge, and the C-shaped outer shape of the lower ridge tapers from the opening of the lower ridge to a lowermost point of the lower ridge.

12. A panel for a backpack comprising a backpack body, the panel comprising: a peripheral portion; at least one inlet-hole; at least one forwardly extending ridge; and at least one through-hole, the peripheral portion being attachable to the backpack body, the at least one inlet-hole being positioned along the peripheral portion to allow air to flow therethrough and into an air gap defined between the panel and the backpack body when the peripheral portion is attached to the backpack body, the at least one forwardly extending ridge defining a recessed portion, the at least one through-hole being formed in the recessed portion, an air-moving device being mountable in the at least one through-hole with an outlet portion of the air-moving device being positioned in front of the recessed portion, and an inlet portion of the air-moving device positioned behind the recessed portion in the air gap, the inlet portion receiving air through the at least one inlet-hole and the outlet portion outputting the air when the air-moving device is mounted in the at least one through-hole and is operating.

13. The panel of clause 12, wherein the at least one forwardly extending ridge helps at least partially trap flowing air within the recessed portion.

14. The panel of clause 13, wherein the at least one forwardly extending ridge comprises an upper ridge and a lower ridge, at least a portion of the recessed portion being between the upper ridge and the lower ridge.

15. The panel of clause 14, wherein each of the upper and lower ridges has C-shaped outer shape with an opening, a portion of the at least one through-hole is positioned within the opening of the lower ridge, the opening of the upper ridge is juxtaposed with the opening of the lower ridge, and at least a portion of the recessed portion is positioned within the opening of the upper ridge and the opening of the lower ridge.

16. The panel of clause 15, wherein the C-shaped outer shape of the upper ridge tapers from the opening of the upper ridge to an uppermost point of the upper ridge, and the C-shaped outer shape of the lower ridge tapers from the opening of the lower ridge to a lowermost point of the lower ridge.

17. The panel of any one of the clauses 14-16, further comprising: a stepped portion that extends from the recessed portion to the upper ridge.

18. The panel of any one of the clauses 12-17, wherein the at least one inlet-hole comprises a plurality of through-holes arranged along the peripheral portion.

19. The panel of clause 18, wherein the plurality of through-holes extends along a lower portion of the peripheral portion and up first and second sides of the peripheral portion, at least a first one of the plurality of through-holes is positioned along the first side at a location that is above the at least one through-hole, and at least a second one of the plurality of through-holes is positioned along the second side at a location that is above the at least one through-hole.

20. The panel of any one of the clauses 12-19 constructed from a single piece of molded material.

21. The panel of any one of the clauses 12-20, wherein the at least one through-hole is defined by a peripheral edge comprising a plurality of notches, and the plurality of notches is configured to receive a plurality of tabs of a cover when the air-moving device is not mounted in the at least one through-hole, the cover covering the at least one through-hole when installed therein.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

As used herein, a term joining items in a series (e.g., the term "or," the term "and," or the like) does not apply to the entire series of items, unless specifically stated otherwise or otherwise clearly contradicted by context. For example, the phrase "a plurality of A, B, and C" (with or without the Oxford comma) refers to a subset including at least two of the recited items in the series. Thus, the phrase refers to (1) at least one A and at least one B but not C, (2) at least one A and at least one C but not B, (3) at least one B and at least one C but not A, and (4) at least one A and at least one B and at least one C. Similarly, the phrase "a plurality of A, B, or C" (with or without the Oxford comma) refers to a subset including at least two of the recited items in the series. Thus, this phrase also refers to (1) at least one A and at least one B but not C, (2) at least one A and at least one C but not B, (3) at least one B and at least one C but not A, and (4) at least one A and at least one B and at least one C.

By away of another example, conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

The invention claimed is:

1. A backpack comprising:

a backpack body;

a forward-facing panel attached to the backpack body, the forward-facing panel having at least one through-hole formed therein to allow air to flow into a gap defined between the forward-facing panel and the backpack body, the forward-facing panel having a forward-facing contoured surface that comprises at least one forwardly extending ridge that rests on a back of a wearer when the backpack is worn by the wearer to space a recessed portion of the forward-facing panel away from the back of the wearer; and an air-moving device mountable to a lower portion of the forward-facing panel in the recessed portion of the forward-facing panel, wherein when the air-moving device is mounted in the recessed portion:

a portion of the air-moving device is flush with a forwardmost point of the at least one forwardly extending ridge, an outer portion of the air-moving device extends forwardly from the forward-facing panel, and comprises one or more outlets formed in a top portion of the air-moving device, the one or more outlets being positioned inside the recessed portion to guide air upwardly when the air-moving device is operating and causing air to flow out of the one or more outlets, an inner portion of the air-moving device is positioned in the gap and comprises one or more inlets positioned inside the gap, and the air-moving device causes air to flow into the gap through the at least one through-hole and into the one or more inlets when the air-moving device is operating.

2. The backpack of claim 1, wherein the at least one forwardly extending ridge comprises an upper ridge and a lower ridge, at least a portion of the recessed portion being between the upper ridge and the lower ridge.

3. The backpack of claim 2, wherein the forward-facing contoured surface comprises a stepped portion that extends from the recessed portion to the upper ridge.

4. The backpack of claim 1, wherein the at least one through-hole comprises a plurality of through-holes arranged along a portion of a periphery of the forward-facing panel.

5. The backpack of claim 4, wherein the plurality of through-holes extends along a lower portion of the periphery and up first and second sides of the periphery, at least a first one of the plurality of through-holes is positioned along the first side at a location that is above the air-moving device when the air-moving device is mounted in the recessed portion, and at least a second one of the plurality of through-holes is positioned along the second side at a location that is above the air-moving device when the air-moving device is mounted in the recessed portion.

6. The backpack of claim 1, wherein the air-moving device comprises an outer housing, and the forward-facing panel comprises an opening into which the outer housing is mountable.

7. The backpack of claim 6, wherein the outer housing is removable from the opening, and the backpack further comprises:

a cover to be positioned inside the opening after the outer housing is removed from the opening.

8. The backpack of claim 1, wherein the at least one forwardly extending ridge helps at least partially trap flowing air within the recessed portion.

9. The backpack of claim 8, wherein the at least one forwardly extending ridge comprises an upper ridge and a lower ridge, each of the upper and lower ridges has a C-shaped outer shape with an opening, the opening of the upper ridge is juxtaposed with the opening of the lower ridge, a portion of the air-moving device is positioned within the opening of the lower ridge when the air-moving device is mounted in the recessed portion, and at least a portion of the recessed portion is positioned within the opening of the upper ridge and the opening of the lower ridge.

10. The backpack of claim 9, wherein the C-shaped outer shape of the upper ridge tapers from the opening of the upper ridge to an uppermost point of the upper ridge, and the C-shaped outer shape of the lower ridge tapers from the opening of the lower ridge to a lowermost point of the lower ridge.

11. The backpack of claim 1, wherein the air- moving device has an outer surface positioned to contact the back of the wearer when the backpack is worn by the wearer and the air-moving device is mounted in the recessed portion.

12. A backpack comprising:

a backpack body;

an air-moving device comprising an inlet portion opposite an outlet portion, the outlet portion comprising a top portion with at least one outlet formed therein; and a panel comprising a peripheral portion attachable to the backpack body, at least one inlet-hole being positioned along the peripheral portion to allow air to flow therethrough and into an air gap defined between the panel and the backpack body when the peripheral portion is attached to the backpack body, the panel comprising at least one forwardly extending ridge defining a recessed portion comprising at least one through-hole positioned in a lower portion of the panel, the air-moving device being mountable in the at least one through-hole with the outlet portion being positioned in front of the recessed portion such that when the air-moving device is operating the at least one outlet is positioned to direct air upwardly along the recessed portion, the inlet portion to be positioned behind the recessed portion in the air gap when the air-moving device is mounted in the at least one through-hole, the inlet portion receiving air through the at least one inlet-hole when the air-moving device is mounted in the at least one through-hole and is operating, a portion of the air-moving device being flush with a forwardmost point of the at least one forwardly extending ridge when the air-moving device is mounted in the at least one through-hole.

13. The backpack of claim 12, wherein the at least one forwardly extending ridge helps at least partially trap flowing air within the recessed portion.

14. The backpack of claim 13, wherein the at least one forwardly extending ridge comprises an upper ridge and a lower ridge, at least a portion of the recessed portion being between the upper ridge and the lower ridge.

15. The backpack of claim 14, wherein each of the upper and lower ridges has a C-shaped outer shape with an opening, a portion of the at least one through-hole is positioned within the opening of the lower ridge, the opening of the upper ridge is juxtaposed with the opening of the lower ridge, and at least a portion of the recessed portion is positioned within the opening of the upper ridge and the opening of the lower ridge.

16. The backpack of claim 15, wherein the C-shaped outer shape of the upper ridge tapers from the opening of the upper ridge to an uppermost point of the upper ridge, and the C-shaped outer shape of the lower ridge tapers from the opening of the lower ridge to a lowermost point of the lower ridge.

17. The backpack of claim 14, further comprising:

a stepped portion that extends from the recessed portion to the upper ridge.

18. The backpack of claim 12, wherein the at least one inlet-hole comprises a plurality of through-holes arranged along the peripheral portion.

19. The backpack of claim 18, wherein the plurality of through-holes extends along a lower portion of the peripheral portion and up first and second sides of the peripheral portion, at least a first one of the plurality of through-holes is positioned along the first side at a location that is above the at least one through-hole, and at least a second one of the plurality of through-holes is positioned along the second side at a location that is above the at least one through-hole.

20. The backpack of claim 12, wherein the panel is constructed from a single piece of molded material.

21. The backpack of claim 12, wherein the at least one through-hole is defined by a peripheral edge comprising a plurality of notches, and the plurality of notches is configured to receive a plurality of tabs of a cover when the air-moving device is not mounted in the at least one through-hole, the cover covering the at least one through-hole when installed therein.

22. The backpack of claim 12, wherein an outer surface of the air-moving device is positioned to contact a back of a wearer when the backpack is worn by the wearer and the air-moving device is mounted in the at least one through-hole.

23. A backpack comprising:

a backpack body;

a forward-facing panel attached to the backpack body, the forward-facing panel comprising an opening, the forward-facing panel having at least one through-hole formed therein to allow air to flow into a gap defined between the forward-facing panel and the backpack body, the forward-facing panel having a forward-facing contoured surface that comprises at least one forwardly extending ridge that rests on a back of a wearer when the backpack is worn by the wearer to space a recessed portion of the forward-facing panel away from the back of the wearer;

an air-moving device mountable in the recessed portion of the forward- facing panel, an outer portion of the air-moving device extending forwardly from the forward-facing panel when the air-moving device is mounted in the recessed portion, the air-moving device comprising an outer housing that is mountable in and removable from the opening of the forward-facing panel, an inner portion of the air-moving device being positioned in the gap when the air-moving device is mounted in the recessed portion, the inner portion comprising one or more inlets positioned inside the gap when the air-moving device is mounted in the recessed portion, the outer portion comprising one or more outlets positioned inside the recessed portion when the air-moving device is mounted in the recessed portion, the air-moving device causing air to flow into the gap through the at least one through-hole and into the one or more inlets when the air-moving device is operating and is mounted in the recessed portion, the air-moving device causing air to flow out the one or more outlets when the air-moving device is operating and is mounted in the recessed portion; and a cover to be positioned inside the opening after the outer housing is removed from the opening.

24. The backpack of claim 23, wherein the at least one forwardly extending ridge comprises an upper ridge and a lower ridge, at least a portion of the recessed portion being between the upper ridge and the lower ridge.

25. The backpack of claim 24, wherein the forward-facing contoured surface comprises a stepped portion that extends from the recessed portion to the upper ridge.

26. The backpack of claim 23, wherein the at least one through-hole comprises a plurality of through-holes arranged along a portion of a periphery of the forward-facing panel.

27. The backpack of claim 26, wherein the plurality of through-holes extends along a lower portion of the periphery and up first and second sides of the periphery, at least a first one of the plurality of through-holes is positioned along the first side at a location that is above the air-moving device when the air-moving device is mounted in the recessed portion, and at least a second one of the plurality of through-holes is positioned along the second side at a location that is above the air-moving device when the air-moving device is mounted in the recessed portion.

28. The backpack of claim 23, wherein the outer housing has a flat surface positioned in the outer portion, and the flat surface is positioned rearwardly with respect to a forwardmost point of the at least one forwardly extending ridge when the air-moving device is mounted in the recessed portion.

29. The backpack of claim 23, wherein the at least one forwardly extending ridge helps at least partially trap flowing air within the recessed portion.

30. The backpack of claim 29, wherein the at least one forwardly extending ridge comprises an upper ridge and a lower ridge, each of the upper and lower ridges has a C-shaped outer shape with an opening, the opening of the upper ridge is juxtaposed with the opening of the lower ridge, a portion of the air-moving device is positioned within the opening of the lower ridge when the air-moving device is mounted in the recessed portion, and at least a portion of the recessed portion is positioned within the opening of the upper ridge and the opening of the lower ridge.

31. The backpack of claim 30, wherein the C-shaped outer shape of the upper ridge tapers from the opening of the upper ridge to an uppermost point of the upper ridge, and the C-shaped outer shape of the lower ridge tapers from the opening of the lower ridge to a lowermost point of the lower ridge.

32. The backpack of claim 23, wherein the air-moving device has an outer surface positioned to contact the back of the wearer when the backpack is worn by the wearer and the air-moving device is mounted in the recessed portion.

33. The backpack of claim 23, wherein a portion of the air-moving device is flush with a forwardmost point of the at least one forwardly extending ridge when the air-moving device is mounted in the recessed portion.

34. A panel for a backpack comprising a backpack body, the panel comprising:

a peripheral portion attachable to the backpack body;

at least one inlet-hole positioned along the peripheral portion to allow air to flow therethrough and into an air gap defined between the panel and the backpack body when the peripheral portion is attached to the backpack body;

at least one forwardly extending ridge defining a recessed portion, the at least one forwardly extending ridge helping at least partially trap flowing air within the recessed portion, the at least one forwardly extending ridge comprising an upper ridge and a lower ridge, at least a portion of the recessed portion being between the upper ridge and the lower ridge, each of the upper and lower ridges having a C-shaped outer shape with an opening, the opening of the upper ridge being juxtaposed with the opening of the lower ridge, at least a portion of the recessed portion being positioned within the opening of the upper ridge and the opening of the lower ridge, the C-shaped outer shape of the upper ridge tapering from the opening of the upper ridge to an uppermost point of the upper ridge, the C-shaped outer shape of the lower ridge tapering from the opening of the lower ridge to a lowermost point of the lower ridge; and at least one through-hole formed in the recessed portion, a portion of the at least one through-hole being positioned within the opening of the lower ridge, an air-moving device being mountable in the at least one through-hole with an outlet portion of the air-moving device to be positioned in front of the recessed portion, and an inlet portion of the air-moving device to be positioned behind the recessed portion in the air gap, the inlet portion to receive air through the at least one inlet-hole and the outlet portion to output the air when the air-moving device is mounted in the at least one through-hole and is operating.

35. The panel of claim 34, further comprising:

a stepped portion that extends from the recessed portion to the upper ridge.

36. The panel of claim 34, wherein the at least one inlet-hole comprises a plurality of through-holes arranged along the peripheral portion.

37. The panel of claim 36, wherein the plurality of through-holes extends along a lower portion of the peripheral portion and up first and second sides of the peripheral portion, at least a first one of the plurality of through-holes is positioned along the first side at a location that is above the at least one through-hole, and at least a second one of the plurality of through-holes is positioned along the second side at a location that is above the at least one through-hole.

38. The panel of claim 34 constructed from a single piece of molded material.

39. The panel of claim 34, wherein the at least one through-hole is defined by a peripheral edge comprising a plurality of notches, and the plurality of notches is configured to receive a plurality of tabs of a cover when the air-moving device is not mounted in the at least one through-hole, the cover covering the at least one through-hole when installed therein.

40. The panel of claim 34, wherein the panel is comprised in a backpack comprising the backpack body attached to the peripheral portion of the panel, and the air-moving device mounted in the at least one through-hole of the panel.

41. The panel of claim 34, wherein the panel is comprised in a backpack comprising the backpack body attached to the peripheral portion of the panel, and the air-moving device mounted in the at least one through-hole of the panel, a portion of the air-moving device being flush with a forwardmost point of the at least one forwardly extending ridge.

* * * * *